US005326022A

United States Patent [19]

Green

[11] Patent Number: 5,326,022

[45] Date of Patent: Jul. 5, 1994

[54] CARTON WITH VENT OPENING ARRANGEMENT

[75] Inventor: James R. Green, Tuscaloosa, Ala.

[73] Assignee: Gulf States Paper Corporation, Tuscaloosa, Ala.

[21] Appl. No.: 74,757

[22] Filed: Jun. 10, 1993

[51] Int. Cl.[5] ..... B65D 5/54

[52] U.S. Cl. ..... 229/120; 229/125.35; 229/207; 229/242; 229/902

[58] Field of Search ..... 229/120, 125.35, 207, 229/243, 242, 902, 903, 905, DIG. 14

[56] References Cited

U.S. PATENT DOCUMENTS

| | | | |
|---|---|---|---|
| 3,183,800 | 5/1965 | Farrell et al. | 229/207 |
| 3,185,578 | 5/1965 | Scharre | 229/207 |
| 3,550,835 | 12/1970 | Persson | 229/903 |
| 4,291,806 | 9/1981 | Austin . | |
| 4,531,668 | 7/1985 | Forbes, Jr. | 229/207 |
| 4,871,071 | 10/1989 | Zimmermann | 229/903 |
| 4,886,170 | 12/1989 | Willey et al. | 229/905 |
| 4,955,530 | 9/1990 | Rigby et al. | 229/120 |
| 4,971,218 | 11/1990 | Buchner et al. | 229/120 |
| 5,078,273 | 1/1992 | Kuchenbecker | 229/243 |

FOREIGN PATENT DOCUMENTS

| | | | |
|---|---|---|---|
| 2234958 | 2/1991 | United Kingdom | 229/125.35 |

*Primary Examiner*—Gary E. Elkins
*Attorney, Agent, or Firm*—Cushman, Darby & Cushman

[57] ABSTRACT

A one-piece carton formable into an enclosed container and suited to retain consumable contents therein. The carton blank is cut and scored to include a bottom wall panel, four side wall panels integral with the bottom wall panel along four side fold lines and foldable along the side fold lines to form container sides. Integral connections, which are foldable and sealable to form leak tight sealed integral corners, are provided between adjacent side wall panels. A lid wall panel is integral with a side wall panel and foldable inward toward the bottom wall panel. Cuts in the lid wall panel define a vent access section which can be manually removed from the lid wall panel along a predetermined vent separation path as a result of a manual venting procedure. The vent access section includes a grippable portion extending from an edge of the lid wall panel. Cuts in the lid wall panel also define an eating access section which can be manually separated from the lid wall panel along a predetermined eating access separation path in response to a manual eating access operating procedure. The exposure of the vent access opening also exposes a portion of the eating section communicating therewith which can then be quipped as an initial step in the manual access operating procedure.

22 Claims, 3 Drawing Sheets

CARTON WITH VENT OPENING ARRANGEMENT

This invention relates to carton-type containers suitable to contain consumable contents therein including at least one venting arrangement capable of providing a vent access opening to the interior of the container for venting the consumable contents therein as they are heated within the container, and, in particular, to a venting arrangement in which the container lid includes a removable vent access section, such that when the removable vent access section is removed it (1) exposes a vent access opening thereby venting the contents of the container, and (2) exposes a grippable portion of an eating access section thereby enabling the eating access section of the container lid to be easily gripped and moved to an eating access position.

Cartons have been developed that are capable of containing edible products therein and that allow the edible contents to be heated in an oven, for example, a microwave oven, while still contained in the carton. To ensure adequate heating of the edible contents, it is known to provide vents in the carton that allow gases, steam and the like to escape from the enclosed container during the heating process. Without a vent, the gases, steam, and the like may accumulate within the enclosed container causing the food contained therein to become soggy and unappetizing. If, however, too much gas, steam and the like are vented from the enclosed container during the heating process, the food contained therein may not heat properly and become dried out and unappealing.

One such venting arrangement is taught by U.S. Pat. No. 4,291,806, which discloses the use of a vent flap located at a corner of the container lid as a means for venting the interior of a container. Perforations in the container lid and along a fold line where two wall panels meet to form an edge allow the vent flap to be separated from the container lid and folded away from the enclosed container space along an adjacent fold line formed along an adjacent edge of the container. Opening such a venting arrangement, however, is made difficult by the fact that opening the vent requires the user to slip a fingernail or other rigid flat object into a vent slit in order to gain gripping access to a portion of the vent flap. Furthermore, when the vent flap is in an open position, i.e. folded away from the interior of the container along a fold line of the container, the vent flap protrudes from the container in a obstructive manner and is aesthetically unappealing.

Other prior art venting arrangements provide a venting access to the consumable contents that vents the interior of the container and facilitates the opening of the container after the vent is opened. When such an arrangement is in an open position, the vent section of the lid panel remains integral with the lid panel rather than being separated therefrom. Venting is achieved by gripping and pulling on a portion of the lid panel causing a portion of the lid wall panel to peel or separate from the container space thereby exposing a vent opening. Because the vent flap is integral with the lid, this venting arrangement allows for removal of the lid panel after the heating is completed by continuing to pull on the grippable portion of the lid panel. This venting arrangement, however, has the disadvantage in that the size of the vent opening varies depending on the force used to peel back the venting portion of the lid panel.

As a result, it is difficult to maintain a uniformly sized vent opening in each container. For example, if too little force is used in partially detaching a portion of the lid panel to vent the container, the size of the vent opening created may be insufficient to adequately vent the container. If too great a force is used to open the vent, the size of the vent opening may be too large, thereby resulting in an excessive exposure of the edible contents as they are heated in the oven. As with the previous venting arrangement, when the vent is open a portion of the lid panel obstructively protrudes from the container package.

Other venting arrangements are known which have only perforations or cuts in the lid of the container. Opening this type of vent requires the user to separate or rupture the perforations by applying pressure thereto. Typically, a downward force directed into the container is required in order to rupture the venting perforations. A disadvantage with this type of venting arrangement is that it can be difficult to determine the proper force required to cause the vent to open. For example, if too much force is applied to the perforations directed toward the interior of the container, the edible contents contained therein may be disturbed or damaged should the perforations rupture suddenly or unexpectedly, and excessive tearing of the lid panel may also result. If too little force is applied, the vent may not be opened to a sufficient size so as to allow the optimum venting of the container. Also, this venting arrangement does not provide a means for easily removing the lid or a portion of the lid for accessing the contents therein after heating is completed.

It is an object of the present invention to provide a carton-type container including a venting arrangement which overcomes the problems associated with the prior art as discussed above. In accordance with the principles of the present invention, this objective is achieved by providing a one-piece carton blank of foldable sheet material which is formable into an enclosed container. The container is suited to retain consumable contents therein, including liquids, so that the consumable contents are heated in an oven while retained therein and thereafter consumed while retained therein. The carton blank is cut and scored such that the carton blank includes a bottom wall panel which has a periphery defined by four interconnecting side fold lines. The side fold lines are situated such that there are four different pairs of adjacent side fold lines wherein each pair of adjacent side fold lines extends at an angle with respect to each other from a corner point defining one of four corners of the bottom wall panel. Four side wall panels are integral with the bottom wall panel along the side fold lines and interrelated so that there are a first pair of opposed side wall panels, a front side wall panel, and a rear side wall panel. The side wall panels are foldable along the side fold lines in a uniform direction relative to the bottom wall panel to form compartment sides. Integral connections are provided between adjacent side wall panels. The integral connections are foldable and sealable to form leak tight sealed integral corners. A lid wall panel is integral with the rear side wall panel along a lid fold line. The lid wall panel is foldable along the lid fold line in a direction inward toward the bottom wall panel such that in a closed position, the lid wall panel encloses a container space defined by the bottom wall panel and the four side wall panels wherein the consumable contents are contained. The lid wall panel has cuts therein defining a vent access section, which is capable of being manually removed from the lid wall panel along a predetermined vent separation path as a result of a manual venting procedure. The vent access section includes a grippable portion extending from an edge of the lid wall panel that is capable of being gripped as on initial step in the manual venting procedure. The lid wall panel also has cuts therein defining an eating access section. The eating access section is capable of being manually separated from the lid wall panel along a predetermined eating access separation path in response to a manual eating access operating procedure, thus enabling the eating access section to be manually moved to an access position during the manual eating access operating procedure. The exposure of the vent access opening also exposes a portion of the eating access section communicating therewith which is capable of being gripped as an initial step in the manual access operating procedure.

It is a further object of the present invention to provide a venting arrangement which is simple in construction, economical in manufacture, effective in operation, and designed such that operating the vent does not impair the structural integrity of the carton or damage the contents of the container.

These and other objects of the present invention will become more apparent during the course of the following detailed description and appended claims.

The invention may best be understood with reference to the accompanying drawings wherein illustrative embodiments are shown.

IN THE DRAWINGS

Figure 1:
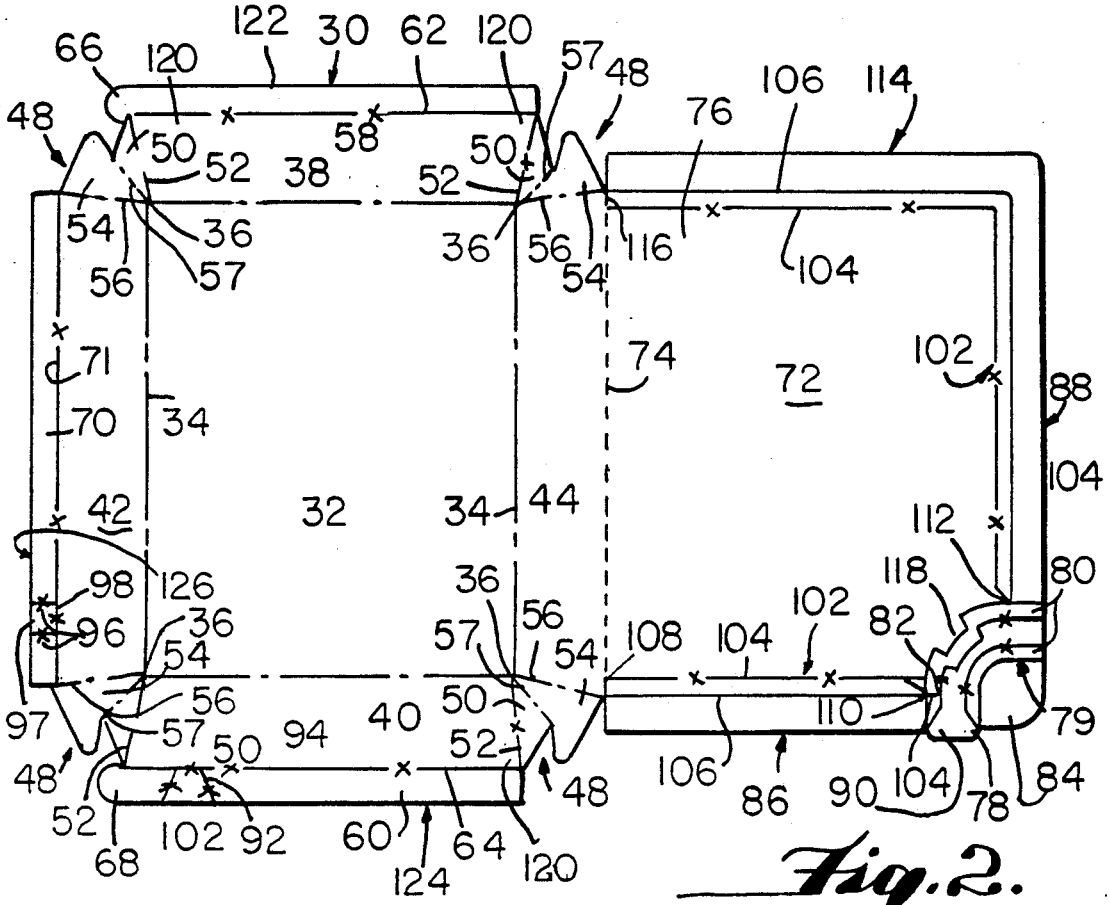
FIG. 1 is a plan view of one embodiment of a carton tray blank including a venting arrangement according to the principles of the present invention.

Referring now more particularly to FIG. 1 of the drawings, there is shown therein a one-piece carton tray blank, generally indicated at 30, which is erectable into a carton tray having a venting arrangement in accordance with the principals of the present invention. The carton tray blank 30 is formed of any suitable sheet material as, for example, paperboard. It will be understood that the carton material may be in the form of a laminate, such as a plastic film (e.g., polypropylene or PET) laminated to the paperboard. Preferably, the plastic film is on the interior surface of the paperboard carton blank although it may be provided on the exterior surface as well. The laminate may include in selectable portions throughout the paperboard material, a microwave-interactive or microwave-shielded material.

As shown, the carton tray blank 30 is formed of foldable sheet material and is suitably cut and/or scored to provide a bottom wall panel 32 defined peripherally by four interconnecting side fold lines 34. The side fold lines 34 are interrelated such that there are four different pair of adjacent side fold lines defining four corners points 36. Each adjacent side fold line extends at an angle with respect to each other from a corner point 36 thereby defining a corner of the bottom wall panel. The carton tray blank 30 includes four side wall panels 38, 40, 42, and 44, which are integral with the bottom wall panel 32 along side fold lines 34 and interrelated such that there are a pair of opposed side wall panels 38 and 40, a front side wall panel 42, and a rear side wall panel 44. The side fold lines 34 may be of any desired construction, an exemplary embodiment being regular barscores as viewed from the side of the carton tray blank 30 forming the exterior of the carton tray when erected. The regular barscores are indicated in FIG. 1 by a solid line broken with a dash, "-". The side of the carton tray blank shown in FIG. 1 corresponds to the exterior surface of the carton tray when the carton tray blank 30 is erected. The side opposite that shown in FIG. 1 is also the side of the paperboard carton tray blank 30 on which the plastic film is adhered when the blank is made of a laminate.

The carton tray blank 30 includes four integral corner connections, generally indicated at 48, which are foldable to form sealable leak tight corner connections between adjacent side wall panels when the carton tray blank 30 is in an erected position. As shown, each integral corner connection 48 includes a first gusset wall panel 50 integral with one of the side wall panels 38 and 40 along a first end fold line 52, and a second gusset wall panel 54 integral with either the front wall panel 42 or the rear side wall panel 44 along a second end fold line 56. Each first gusset wall panel 50 is integral with each second gusset wall panel 54 along a central gusset fold line 57. The two end fold lines 52 and 56 and central gusset fold line 57 extend from an associated corner 36 in an angularly related relations with respect to one another. It is to be understood that the end fold lines 52 and 56 and the central gusset fold line 57 need not extend exactly from the corner 36, but may be offset to an extent generally equal to the thickness of the paperboard material. In an exemplary embodiment of the present invention the first end fold line 52 forms an angle of approximately 100° with respect to the adjacent side fold line 34 and the second end fold line 56 forms an angle of approximately 98° with respect to the adjacent side fold line 34. The first end fold lines 52 in an exemplary embodiment, are reverse barscored, i.e. barscored on the side of the carton blank opposite that shown in FIG. 1. Reverse barscores are indicated in FIG. 1 by a solid line broken with an "x". The second end fold line 56 and central gusset fold line 57 may exemplarily be regular barscored.

The side wall panels 38 and 40 include edge wall panels 58 and 60 integral therewith along edge fold lines 62 and 64. The edge fold lines 62 and 64 are generally parallel with respect to the side fold lines 34 and in an exemplary embodiment are reverse barscored so that the edge wall panels 58 and 60 may be folded outward with respect to the bottom wall panel 32. The edge wall panels 58 and 60 include end portions 66 and 68 located at an end of the edge wall panels 58 and 60 proximate to the front wall panel 42 and extending beyond the end of the edge fold lines 62 and 64 in a direction generally parallel to the end fold lines 34.

The front side wall panel 42 includes a front flap wall panel 70 integral therewith along a front flap fold line 71. The front flap fold line 71 is generally parallel to the side fold line 34 and in an exemplary embodiment of the present invention, reverse barscored so as to enable the front flap wall panel 70 to be folded outward with respect to the bottom wall panel 32.

The rear side wall panel 44 includes a lid wall panel 72 integral therewith along a lid fold line 74. The lid fold line 74 may be regular barscored or in an exemplary embodiment, perforated. Perforations are indicated in FIG. 1 by a dashed line. The lid wall panel 72 includes cuts therein defining an eating access section 76, which is movable to expose an eating access to the contents within the container, and a vent access section 78, which is removable so as to expose a vent access opening to the interior of the container, and to expose a portion of the eating access section.

The vent access section 78 is defined by a pair of partial depth cuts 80 in the exterior surface of the lid wall panel 72 and a pair of partial depth cuts 82 in the interior surface of the lid wall panel 72. The pair of partial depth cuts 80 and 82 in the lid wall panel 72 enable the vent access section 78 to be manually removed from the lid wall panel 72 along a predetermined vent separation path, generally indicated at 79, in response to a manual venting procedure. The partial depth cuts in the exterior surface of the carton blank are indicated by a solid line including slashes, "|"s, therein. The partial depth cuts in the interior surface of the carton blank are indicated by a solid line including "x"s therein. As shown, the pair of exterior partial depth cuts 80 are located outside the pair of interior partial depth cuts 82. The exterior and interior partial depth cuts 80 and 82 generally form an arc about a corner 84 of the lid wall panel 72 and extend from a first edge 86 to a second edge 88 of the lid wall panel 72. It is to be understood that the vent access section 78 may extend between any edges of the lid wall panel 72, and may be disposed about any other corner of the lid wall panel 72 or a plurality thereof. The vent access section 78 also includes a grippable portion 90 integral with the lid wall panel 72 and extending beyond the edge 86 of the lid wall panel 72. While the grippable portion 90 is shown as integral with the lid wall panel 72 at an end of the vent access section proximate to the edge 86, it is to be understood that the grippable portion 90 may be located on either end of the vent access section. If, however, the vent access section 78 is located such that an end terminated at the lid fold line 74, the grippable portion 90 could not be integral with that end. Furthermore, that end must have cutscores therein to enable the vent access section 78 to be removed. Perforations in the lid fold line 74 between the pair of exterior partial depth cuts 80, for example, would be sufficient.

To facilitate operation of the vent access section 78, the edge wall panel 60 associated with the edge 86 of the lid wall panel 72 when the lid wall panel 72 is in a closed position includes a pair of reverse cutscores 92. The reverse cutscores 92 are located in the edge wall panel 60 such that the reverse cutscores 92 correspond to the pair of interior partial depth cutscores 82 in each side of the vent access section 78 proximate to the first edge 86 of the lid wall panel 72. The portion of the edge fold line 64 between the reverse cutscores 92 also includes a reverse cutscore 94. Although not shown, the edge wall panel 60 can include an integral protruding portion corresponding the grippable portion 90 in the lid wall panel 72.

Further, the front flap wall panel 70 associated with the second edge 88 of the lid wall panel 72 when the lid wall panel 72 is in a closed position includes a pair of parallel reverse cutscores 96. The reverse cutscores 96 are located in the front flap wall panel 70 such that the reverse cutscores 96 correspond to the pair of interior partial depth cutscores 82 in either side of the vent access section 78 proximate to the first edge 88 of the lid wall panel 72. The portion of the front flap fold line 71 between the reverse cutscores 96 also includes a reverse cutscore 98. It is to be understood that interior partial depth cutscores may be provided instead of the reverse cutscores 92, 94, 96, and 98 so that the interior surface of the edge wall panel 60 and/or front flap wall panel 70 corresponding to the portion 93 and 97 delaminates therefrom, rather than the entire portion 93 and 97 being removed. It is to be further understood that if the edge wall panels 58 and 60 and/or the front flap wall panel 70 are folded in an opposite direction with respect to the bottom wall panel 32 than described above, the cutscores 92, 94, 96 and 98 associated with the vent access section 78 would also be on the opposite side of the edge wall panels 60 and 70 and the above partial depth cutscores would also be in the opposite surface of the carton blank.

The eating access section 76 is defined by partial depth cuts 104 in the interior surface of the lid wall panel 72, and partial depth cuts 106 in the exterior surface of the lid wall panel 72. The interior and exterior partial depth cuts 104 and 106 enable the eating access section 76 to be separated from the lid wall panel 72 along a predetermined eating access separation path, generally indicated at 102. As shown, the interior and exterior partial depth cuts 104 and 106 are generally parallel to each other. The eating access separation path 102 of an exemplary embodiment extends from a first portion 108 of the lid fold line 74 along a path generally parallel to the edge 86 of the lid wall panel 72 to a first portion 110 of the vent access section 78. The interior partial depth cut 104 tapers toward the exterior partial depth cut 106 so as to come together at the first portion 110 of the vent access section 78, which corresponds to the location of the exterior partial depth cut 80*a* (See FIG. 3) of the pair of exterior partial depth cuts 80 in the vent access section 78. The eating access exterior partial depth cut 106 terminates upon intersection with the vent access exterior partial depth 80. The interior partial depth cut 104, however, terminates upon intersection with the interior partial depth cut 82*a* (See FIG. 3) in the pair of interior partial depth cuts 82 of the vent access section 78. The eating access separation path 102 also extends from a second end portion 116 of the lid fold line 74 along a path generally parallel to the third edge 114 and the second edge 88 of the lid wall panel 72 to a second portion 112 of the vent access section 78. The interior partial depth cut 104 tapers toward the exterior partial depth cut 106 so as to come together at the second portion 112 of the vent access section 78, which corresponds to the location of the exterior partial depth cut 80*a* (See FIG. 3) of the pair of exterior partial depth cuts 80 in the vent access section 78. The eating access exterior partial depth cut 106 terminates upon intersection with the vent access exterior partial depth 80. The interior partial depth cut 104, however, terminates upon intersection with the interior partial depth cut 82*a* (See FIG. 3) in the pair of interior partial depth cuts 82 of the vent access section 78.

The eating access section 76 includes a portion 118 therein communicating with the vent access section 78 such that removal of the vent access section 78 exposes the portion 118 of the eating access section 76. In an exemplary embodiment and as illustrated in the Figures, the portion 118 of the eating access section 76 is a grippable tab which is exposed when the vent access section 78 is removed.

Figure 2:
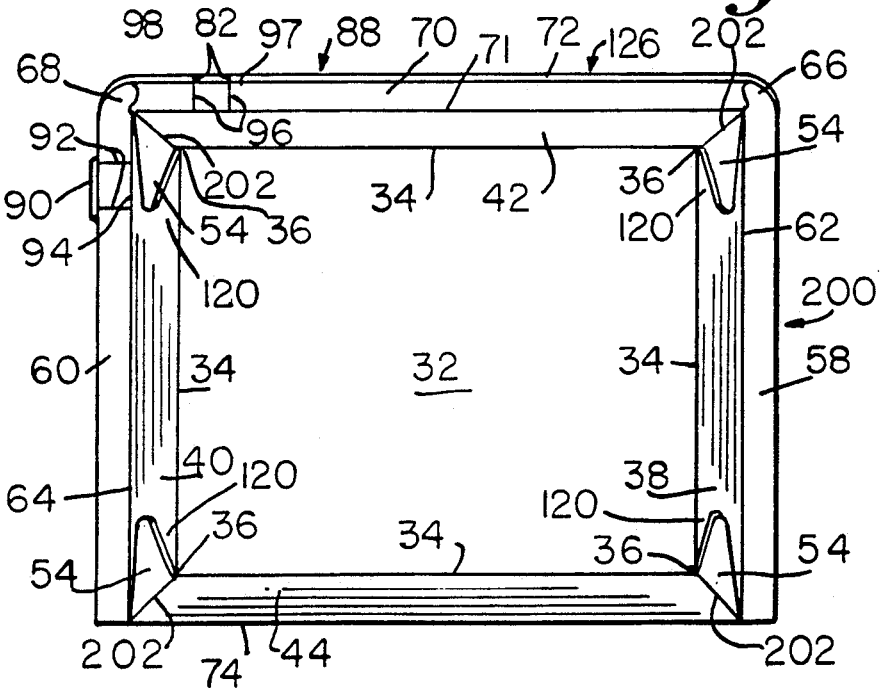
FIG. 2 is a bottom view of a carton tray erected from the carton tray blank of FIG. 1.

Referring to FIGS. 1 and 2, the method in which the carton tray blank 30 is erected to from a carton tray, generally indicated at 200, is described below. FIG. 2 shows the bottom of the erected carton tray 200 in which like numerals apply to like parts to those illustrated in FIG. 1. The opposed side wall panels 38 and 40, front side wall panel 42, and rear side wall panel 44 are foldable in a uniform direction relative to the bottom wall panel 32 along side fold lines 34 to form the sides of the compartment in which the edible contents are contained. Folding the side wall panels in this manner brings the first end fold line 52 and the second end fold line 56 into a superposed relation so as to form a single superposed end fold line 202. The first and second gusset wall panels 50 and 54 are foldable together in a surface-to-surface abutting relationship along the central gusset fold line 58. The abutting gusset wall panels 50 and 54 are then folded together along the superposed end fold lines 202 so as to bring one of the two abutted together gusset wall panels 50 and 54 into a surface-to-surface engagement with an end portion 120 of the side wall panels 38 and 40. It is to be understood that the abutted together gusset wall panels 50 and 54 could also be folded along the superposed end fold lines 202 so that they are brought into engagement with an end portion of one of the rear side wall panel 44 or the front side wall panel 42. The abutted together gusset wall panels are then adhesively adhered to the end portion 120 of the side wall panels 38 and 40 in a surface-to-surface abutting relation to thereby form a sealed integral corner connection, generally indicated at 48, between each pair of adjacent side wall panels.

The adhesive utilized may be of any type including either heat activated or pressure activated adhesives. The adhesive may be separately applied to the appropriate portion of the carton tray blank 30 prior to erection or during erection, it being understood that where the carton material comprises a laminate including a plastic film on the interior surface of the paperboard, portions of the plastic film itself may constitute the adhesive which is activated by heat, and preferably by directing a stream of hot air locally thereto just prior to the erecting procedure.

The edge wall panels 58 and 60 and front flap wall panel 70 are foldable along their respective edge fold lines 62, 64 and 71. The edge wall panel 58 and 60 and front flap wall panel 70 are foldable either inwardly toward the bottom wall panel or outwardly. When folded in an outward position, the edge wall panels 58 and 68 and the front flap wall panel 70 protrude away from the interior of the container tray so as to form a flange around the top portion of the container.

The lid wall panel 72 is foldable along the lid fold line 74 in a direction inward toward the bottom wall panel 32 so that in a closed position the lid wall panel 72 is in a surface-to-surface abutting relationship with a surface of the edge wall panels 58 and 60 and the front flap wall panel 70. When the lid wall panel 72 is in a closed position it encloses a container space defined by the bottom wall panel 32, opposed side wall panels 38 and 40, front side wall panel 42, and the rear side wall panel 44, wherein the consumable contents are contained. The nature of the lid wall panel sealing characteristic is dependent to a considerable extent on the contents to be enclosed within the container space. In some instances where the contents are dry and capable of being reconstituted when water is added thereto, a minimum sealing capability is required. The sealing characteristics desired also has a bearing on whether the edge wall panels 58 and 60 and front flap wall panel 70 are folded outwardly or inwardly and on whether one or more of the edge wall panels 58 and 60 and/or front flap wall panel 70 are eliminated. It is to be understood that the present invention in its broadest form contemplates the elimination of all of the edge wall panels 58, 60 and 70, including the end portions 66 and 68 extending therefrom, where the sealing characteristics required are minimal.

In the embodiment of the present invention shown in FIGS. 1 and 2 the edge wall panels 58 and 60 and the front flap wall panel 43 are folded outward and sealably engage a portion of the lid wall panel 72 near the edge 86, 88 and 114. As shown, the edges 122 and 124 of the edge wall panel 58 and 60 are generally flush with the edges 114 and 86 of the lid wall panel 72, respectively, when the carton tray blank 30 is erected and the lid wall panel 72 is in a closed position. Also, the edge 126 of the front flap wall panel 70 is offset from the edge 88 of the lid wall panel 72. In this arrangement, the end portions 66 and 68 of the edge wall panels 58 and 60 also sealably engage the lid wall panel 72 when the lid wall panel 72 is in a closed position. Additionally, the grippable portion 90 of the vent access section 78 extends beyond edge 86 of the lid wall panel 72, which is generally flush with the edge 124 of the edge wall panel 60.

It is to be understood that the lid wall panel 72 need not be formed integral with the rear side wall panel 44. Rather the container lid may be formed from a separate sheet of material. In such an arrangement, a rear side wall flap (not shown) may be provided which is integral with the rear side wall panel 44 along a rear side wall fold line which corresponds to the lid fold line 74 in FIG. 1. The rear side wall flap in such an arrangement serves to receive and engage the container lid in a manner similar to that of the edge wall panels 58 and 60 as previous discussed. The edge wall panels 58 and 60 may also include opposite end portion (not shown) extending from the edge wall panels 58 and 60 in a manner similar that of the end portion 66 and 68 but in an opposite direction and on the opposite ends of the edge wall panels 58 and 60. The additional end portions sealably engage the lid in a manner similar to the end portions 66 and 68. It is to be further understood that the lid wall panel 72 may include a front lid flap, as discussed below with respect to a second embodiment of the present invention, integral therewith along a front flap fold line corresponding to edge 88 for providing an additional sealing surface for maintaining the lid wall panel 72 in a closed position.

Figure 3:
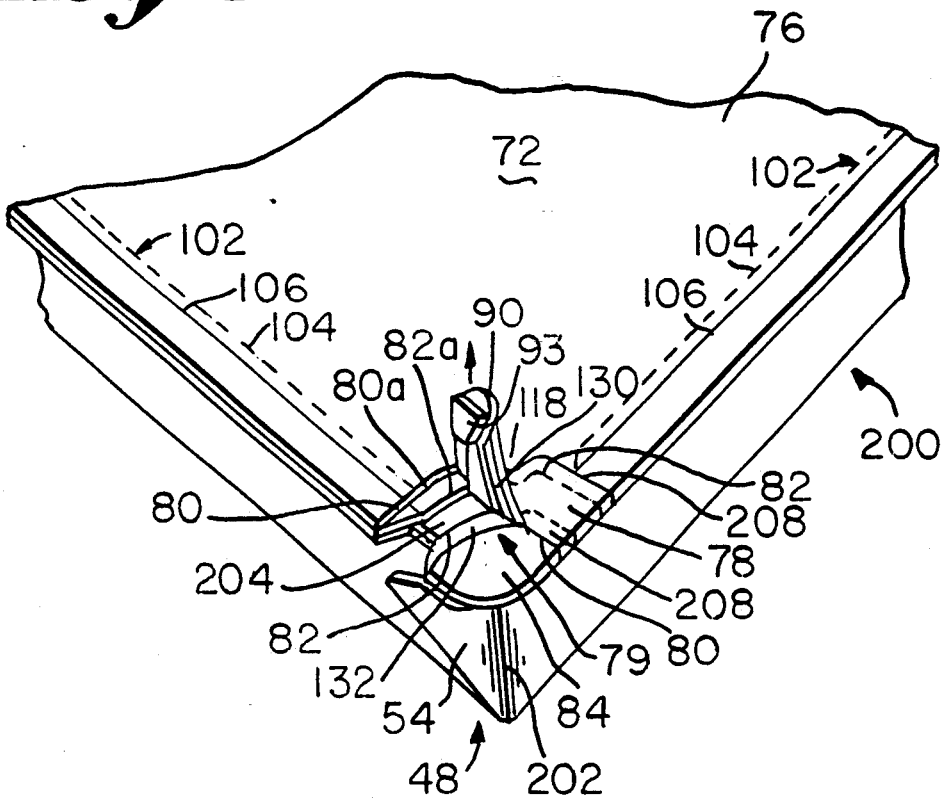
FIG. 3 is a perspective view of an erected carton tray showing the operation of the venting arrangement according to the principles of the present invention.

The operation of the vent access section 78 for venting the interior of the container tray 200 in response to a manual venting procedure is described below with reference to FIG. 3, which is a perspective view of a corner of an erected carton tray according to one embodiment of the present invention. Like numerals are used to identify like parts as those illustrated in FIGS. 1 and 2. The manual venting procedure for venting the interior portion of the container tray 200 begins by manually gripping either the grippable portion 90 of the vent access section 78 alone, which made easy by extending the grippable portion 90 beyond the edge of the lid wall panel 72 as shown in FIGS. 1 and 2, or the grippable portion 90 together with a portion of the edge wall panel 60 associated with the vent access section 78 when the lid wall panel 72 is closed. In this regard, it is to be understood that the edge wall panel associated with the edge of the lid having the grippable portion can also have integral therewith a protruding portion corresponding to the grippable portion 90 thereby facilitating the gripping of both the grippable portion 90 and a portion of the edge wall panel 60.

The next step in the manual venting procedure involves pulling the grippable portion 90 in a direction generally perpendicular to the surface of the lid wall panel 72 causing the vent access section 78 to detach from the lid wall panel 72 along the vent separation path 79 thereby exposing a vent access opening 204. The reverse cutscores 92 and 94 in the edge wall panel associated with the vent access section 78 cause a portion 93 of the edge wall panel 60 defined by the parallel reverse cutscores 92, the reverse cutscore 94, and the edge 124 (See FIG. 1) to detach therefrom and to remain adhered to the vent access section 78 as the vent access section 78 is detached from the lid wall panel 72. The exterior partial depth parallel cuts 80 and interior partial depth parallel cuts 82 cause the vent access section to delaminate along two generally parallel delamination paths 206 and 208. Delamination is the result of the paperboard material forming the lid wall panel 72 separating between the exterior surface 130 and the interior surface 132 due to the exterior and interior partial depth cuts 80 and 82. More specifically, delamination of the vent separation path 206 takes place in a space defined on one side by the exterior partial depth cut 80*a*, which is one of the exterior partial depth cuts in the pair of exterior partial depth cuts 80, and on the other side by the interior partial depth cut 82*a*, which one of the interior partial depth cut in the pair of interior partial depth cuts 82 adjacent to the exterior partial depth cut 80*a*. A similar delamination takes place along the other delamination path 208.

Continued pulling on the grippable portion 90 results in the complete removal of the vent access section 78 from the lid wall panel 72, as the final step in the manual venting procedure. Before the vent access section 78 is completely removed from lid wall panel 72, the portion 97 (See FIG. 1) of the front flap wall panel 70, defined by the parallel reverse cutscores 96, the reverse cutscore 98, and the edge 126, also detaches therefrom and remains adhered to the vent access section 78. Removing the vent access section 78 provides a uniform vent access opening 204 for every container incorporating the venting arrangement of the present invention. Larger vent openings may be created by increasing the distance between the each partial depth cut in the pair of exterior and interior partial depth cuts 80 and 82 and/or by increasing the length of the vent separation path 79 so as to lengthen the vent access section 78 removed from the lid wall panel 72. Removing the vent access section 78 by the aforementioned manual venting procedure exposes a grippable portion 118 of the eating access section 74, thereby providing gripping access to the grippable portion 118.

Figure 4:
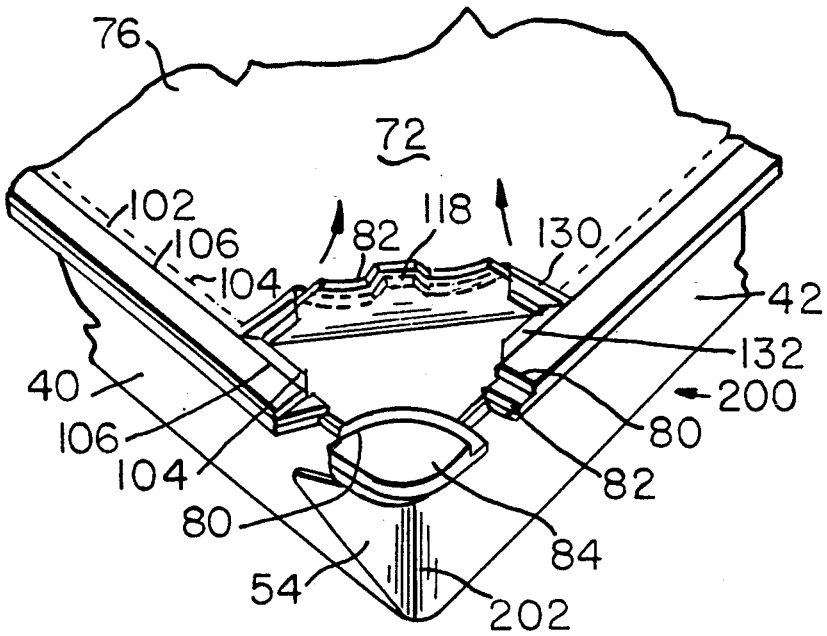
FIG. 4 is a perspective view of an erected carton tray showing the operation of the eating access arrangement according to the principles of the present invention.

Eating access to the consumable contents is obtained by moving the eating access section 76 to an access position by means of a manual eating access operating procedure and is described below with reference to FIG. 4., which is a perspective view of a corner of the carton tray erected from the carton tray blank shown in FIG. 1, wherein like parts as those illustrated in previous figures are identified with like numerals. The manual eating access operating procedure begins by manually gripping the portion 118 of the eating access section 76 exposed by the removal of the vent access section 78. Gripping is made easier by extending the portion 118 of the eating access section 76 so as to form a grippable tab.

The next step in the manual eating access operating procedure involves pulling on the portion 118 of the eating access section 76 in a direction generally perpendicular to the surface of the lid wall panel 72 thereby causing the eating access section 76 to detach from the lid wall panel 72 along an eating access separation path 102. The eating access separation path is defined on one side by an exterior eating access partial depth cut 106 and on the other side by interior eating access partial depth cut 104. Pulling on the exposed portion 118 causes the interior and exterior surface of the paperboard forming the lid wall panel 74 to delaminate or separate between the exterior and interior partial depth cuts 106 and 104. The eating access separation path 102 in an exemplary embodiment and as shown is generally parallel to the edges of the lid wall panel 72. However, it is to be understood that the eating access separation path 102 can be of any desired configuration so as to define any desired outline for the eating access section 76.

Continued pulling on the exposed portion 118 of the eating access section 76 causes the paperboard of the lid wall panel 72 to delaminate or separate along the length of the eating access separation path 102. The eating access section 76 of the lid wall panel 72 can then be either folded back along the lid fold line, thereby providing eating access to the contents of the carton tray 200, or completely removed from lid wall panel 72 if the lid fold line 74 includes perforations therein.

Another embodiment of the present invention, which demonstrates alternative constructions of the container tray, is described below with reference to FIG. 5, which is a plan view of an exterior surface of a carton tray blank, generally indicated at 300, in which features identical to those illustrated in FIGS. 1–4 are referred to with like numerals. As shown, the carton tray blank 300 includes a bottom wall panel 32 defined peripherally on four sides by four side fold lines 34 forming four corner points 36. Four side wall panels 302, 304, 306 and 308 are integral with the bottom wall panel 32 along the side fold lines 34. The side wall panels are interrelated such that there are two opposed side wall panels 302 and 304, a front side wall panel 306 and a rear side wall panel 308. As with the previous embodiment, the side fold lines 34 may be of any desired construction, an exemplary embodiment being regular barscores.

The carton tray blank 300 also includes four integral corner connection, generally indicated at 48, which includes one gusset wall panel 310 in each corner connection 48. Each gusset wall panel 310 is integral with one of the associated side wall panels 302, 304, 306, and 308 along first and second end fold lines 312 and 314, which extend from an associated corner 36 in an angularly related relation with respect to one another. It is to be understood that the end fold lines 312 and 314 need not extend exactly from the corner 36, but may be offset to an extent generally equal to the thickness of the paperboard material. As shown, the first end fold lines 312 are integral with an end of one of the pair of opposed side wall panels 302 and 304 and extend from the associated corner 36 with aspect to the adjacent side fold line 34 at an angle of approximately 90°. The first end fold lines 312 in an exemplarily embodiment are formed by reverse barscores. The second end fold lines 314 are integral with an end of one of the front side wall panel 306 and the rear side wall panel 308 and extend from an associated corner 36 at an angle of approximately 135° with respect to the adjacent side fold line 34. The second end fold lines 314 may be regular barscored.

The pair of opposed side wall panels 302 and 304 include edge wall panels 316 and 318 integral therewith throughout the width thereof along edge fold lines 320 and 322. In an exemplary embodiment, the second end fold lines 314 are reverse barscored enabling the edge wall panels 316 and 318 to fold outward with respect to the bottom wall panel 32. The front side fold panel 306 includes a front flap wall panel 321 integral therewith along a front flap fold line 323. In an exemplary embodiment, the front flap fold line 323 is regular barscored so that the front flap wall panel 321 is foldable inward with respect to the bottom wall panel 32 along the front flap fold line 323.

The rear side wall panel 308 includes a lid wall panel 324 integral therewith along a lid fold line 326. The lid wall panel 324 includes a front lid flap 328 integral therewith along a front lid flap fold line 330, which is generally parallel to the lid fold line 326. In a exemplary embodiment, the lid flap fold line is reverse cutscored. The lid wall panel 324 includes cuts therein defining a vent access section 78 and an eating access section 76, which is movable to expose an eating access to the contents within the container, and a vent access section 78, which is removable so as to expose a vent access opening to the interior of the container, and to expose a portion of the eating access section. It is to be understood that, as with the previous embodiment, the lid wall panel 324 need not be formed integral with the rear side wall panel 304. Rather, the container lid may be formed from a separate sheet of material. In such an arrangement, a rear side wall flap (not shown) may be provided which is integral with the rear side wall panel 304 along a rear side wall fold line which corresponds to the lid fold line 326 in FIG. 5.

As in the previous embodiment, the vent access section 78 is defined by a pair of generally parallel partial depth cuts 80 in the exterior surface of the lid wall panel 324 and a pair of generally parallel interior partial depth vent cuts 82 in the interior surface of the lid wall panel 324. The pair of parallel partial depth cuts 80 and 82 enable the vent access section 78 to be manually removed from the lid wall panel 324 along a predetermined vent separation path, generally indicated at 79, in response to the manual venting procedure. As shown, the exterior and interior partial depth cuts 80 and 82 generally form an arc about a corner 332 of the lid wall panel 324 and extend from a first edge 342 of the lid wall panel 324 to the front lid flap fold line 330. It is to be understood that the vent access section 78 may extend between any edges of the lid wall panel, and may be disposed about other corners of the lid wall panel 324. The vent access section 78 also includes a grippable portion 90 suitable to be gripped as an initial step in the manual venting procedure.

To facilitate operation of the vent access section 78, the edge wall panel 318 associated with the edge 342 of the lid wall panel 72 when the lid wall panel 72 is in a closed position includes a pair of reverse cutscores 92. The reverse cutscores 92 are located in the edge wall panel 318 such that the reverse cutscores 92 correspond to the pair of interior partial depth cutscores 82 in each side of the vent access section 78 proximate to the edge 342 of the lid wall panel 324. The portion of the edge fold line 322 between the reverse cutscores 92 also includes a reverse cutscore 94. It is to be understood that interior partial depth cutscores may be provided in place of the reverse cutscores 92 and 94. It is to be understood that if the edge wall panels 58 and 60 are folded in the opposite direction with resect to the bottom wall panel 32 than described above, the cutscores therein associated with the vent access section 78 would also be in the opposite side of the edge wall panel 318 and front flap wall panel 321 than that described above. It is to be further understood that the edge wall panel 318 may include a protruding portion integral therewith which corresponds to the grippable portion 90 when the lid wall panel 324 is in a closed position.

In this embodiment, the eating access section 76 of the lid wall panel 324, which is movable to expose an eating access to contents of the container tray, encompasses the entire exterior surface of the lid wall panel 342. Partial depth cuts 334 in the interior surface of the lid wall panel 324 define one side of an eating access separation path, generally indicated at 356. The other side of the eating access separation path 356 is defined by the edges 342 and 348 of the lid wall panel 324 and the front lid flap fold line 330. As shown, the partial depth cut 334 extends from an end portion 340 of the lid fold line 326 in a generally parallel relationship with the edge 342 of the lid wall panel 324 and to the interior partial depth cut 80 at a first potion 344 of the vent access section 78. The partial depth cut 334 also extends from an opposite end portion 346 of the lid fold line 326 in a generally parallel relation with the edge 348 and the front lid flap fold line 330 to the interior partial depth cut 80 a second portion 350 of the vent access section 78. It is to be understood, however, that the eating access section 78 may be defined by exterior and interior partial depth cut as set forth in the previous embodiment.

Figure 5:
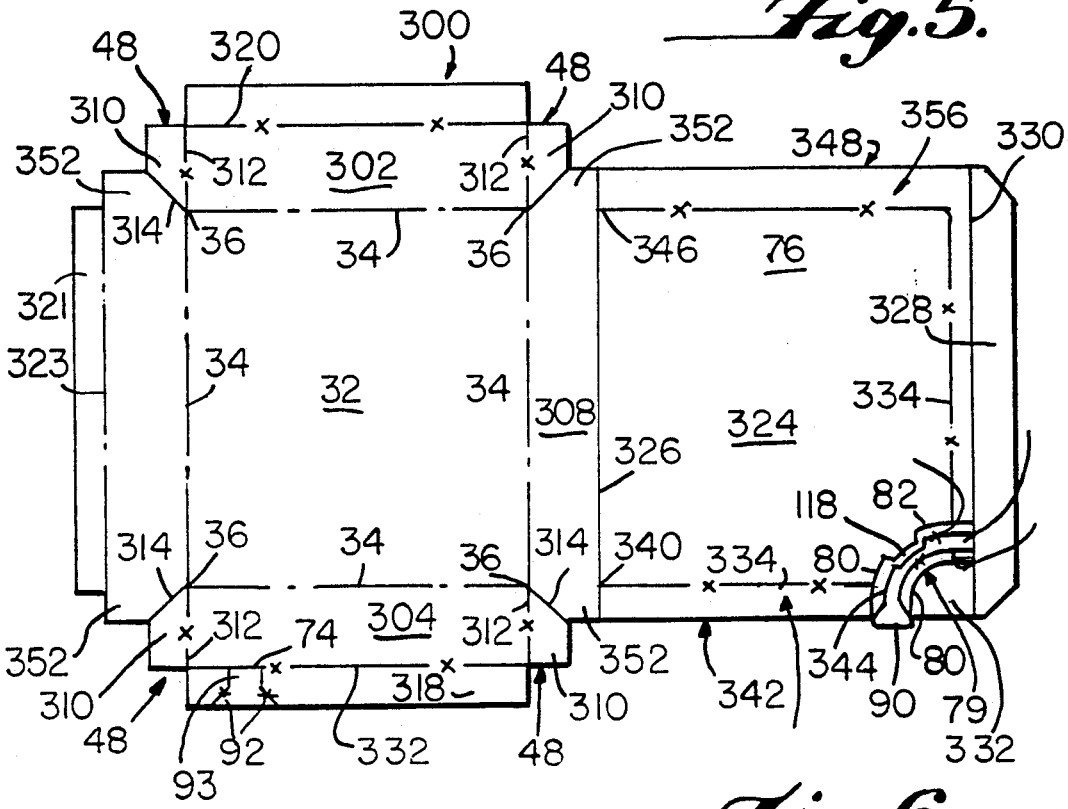
FIG. 5 is a plan view of another embodiment of a carton tray blank according to the principles of the present invention.
Figure 6:
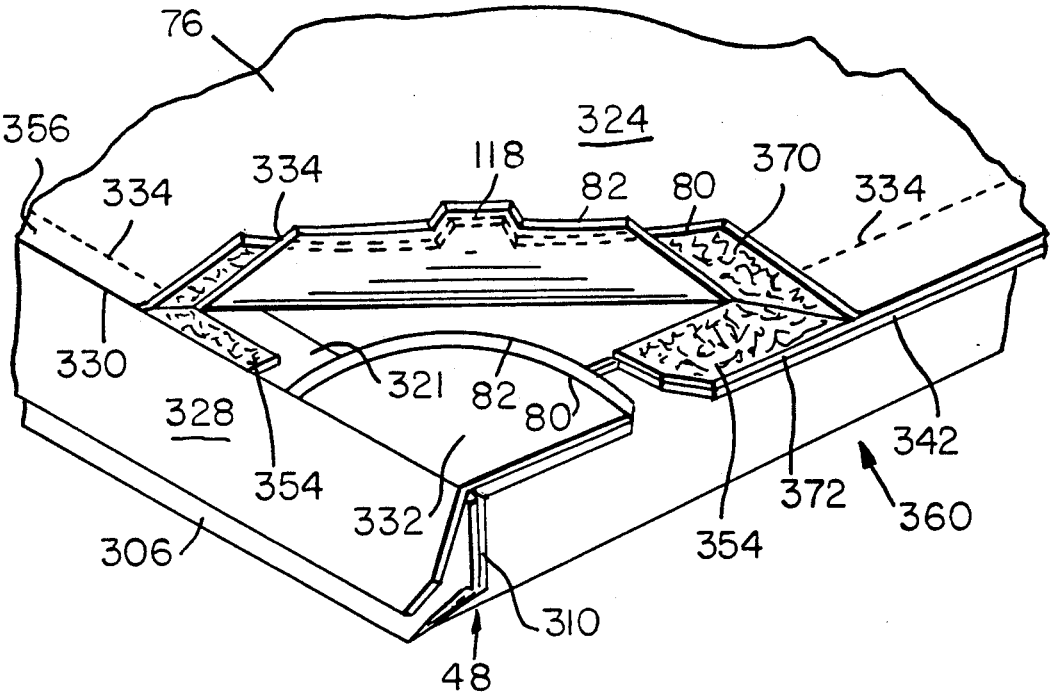
FIG. 6 is a perspective view of a carton tray erected from the carton tray blank of FIG. 5 showing the operation of the eating access arrangement according to the principles of the present invention.

Referring to FIGS. 5 and 6, the method in which the carton tray blank 300 is erected to from a carton tray, generally indicated at 360, is described. The opposed side wall panels 302 and 304, front side wall panel 306, and rear side wall panel 308 are foldable along the side fold lines 34 in a uniform direction inward toward the bottom wall panel 32. Concurrent with the folding of the opposed side wall panels 302 and 304, the gusset wall panels 310 are progressively folded along the angularly related end fold lines 312 and 314 in opposite directions with respect to the associate pair of adjacent side wall panels 302 and 304 so as to bring the gusset wall panels 310 into a surface-to-surface abutting relation with the end portions 352 of one of the front side wall panel 308 and rear side wall panels 308. The gusset wall panels 310 are then adhesively adhered in surface-to-surface abutting relation with the end portions 352 to thereby form a leak-tight, sealed integral corner, generally indicated at 48, between each adjacent side wall panels. The adhesive sealing processes suitable to from the integral corners 48 is the same as that discussed with respect to the first embodiment of the present invention.

The edge wall panels 316 and 318, and front flap wall panel 321 are foldable along their respective edge fold lines 320, 322, and 323 respectively. The front flap wall panel 321 is foldable inward toward the bottom wall panel 32, and the edge wall panels 316 and 318 are foldable either inwardly or outwardly with respect to the bottom wall panel 32 depending on the desired sealing characteristic. In an exemplary embodiment, the edge wall panels 316 and 318 are folded outwardly.

The lid wall panel 324 is foldable along the lid fold line 326 so as to enclose a container space defined by the bottom wall panel 32, the opposed side wall panels 302 and 304, the front side wall panel 306, and the rear side wall panel 308. In an exemplary embodiment, the lid wall panel 324, when in a closed position, sealably engages the interior surface portion of the edge wall panels 316 and 318 and the exterior surface of the front flap wall panel 321. The lid front flap 328 is foldable along the lid front flap fold line 330 so as to sealably engage the exterior surface of the front side wall panel 306. The relatively large surface area of the lid front flap 328 provides additional sealing of the lid wall panel 324 to the container tray 360.

The manual venting procedure for removing the vent access section 78 thereby providing a vent access opening to the contents of the container, is very similar to that discussed with respect to the first embodiment of the present invention. (See FIG. 3). The grippable portion 90 is manually gripped either alone in conjunction with the portion 93 of the edge wall panel 318 as an initial set in the manual venting procedure. A pulling force exerted on the vent access section 78 generally perpendicular to the surface of the lid wall panel 324 causes the vent access section 78 to detach therefrom along the predetermined vent separation path 79 defined by the exterior and interior pair of parallel partial depth cuts 80 and 82 and extending between the edge 342 and the front lid flap fold line 330. The portion 93 of the edge wall panel 318 detaches therefrom an remains adhered to the vent access section 78 as it is removed from the lid wall panel 324. It is to be understood that if partial depth cutscores are provided in place of the cutscores 92 and 94, then the portion 93 does not detach. Rather, the surface of the portion 93 having the partial depth cutscore therein delaminates from the edge wall panel 318. Complete removal of the vent access section 78, which is the final step in the manual venting procedure, exposes the vent opening and gripping access portion 118 of the eating access section 76.

The operation of moving the eating access section to an access position in response to the eating access manual operating procedure is described below with reference to FIG. 6, in which like parts to those illustrated in previous figures are referred to with identical numerals. As with the first embodiment, after the vent access section 78 is removed, a portion 118 of the eating access section 74 is exposed providing gripping access thereto. The manual eating access operation procedure begins by manually gripping the exposed portion 118. Next, a pulling force is exerted on the exposed portion 118 in a direction generally perpendicular to the surface of the lid wall panel 324 causing the eating access section 76 to detach from the carton tray 360 along a eating access separation path, generally indicated at 356. This detaching process is the result of the exterior surface 370 and the interior surface 372 of the paperboard forming the lid wall panel 324 delaminating or separating along a portion 354 defined on one side by the interior partial depth cuts 334 and on the other by the edge 342, the lid front flap fold line 330, and the edge 348, of the lid wall panel 324, as shown in FIG. 5. The delamination of the paperboard splits the paperboard so that the interior surface 372 of the lid wall panel 324 to remain adhered to the edge wall panels 316 and 318 and front flap wall panel 321, while the rest of the paperboard forming the lid wall panel 324, i.e. the exterior surface 370, is detached therefrom. Continued pulling causes the eating access section 76 to delaminate along the length of the eating access separation path 356. The eating access section 76 is then foldable along the lid fold line 326 thereby providing eating access to the contents within the carton tray 360. It is to be understood that the eating access section 76 may be completely removed by providing perforations in the lid fold line 326. In this embodiment of the present invention, the eating access section is such that it encompasses the entire exterior surface portion of the lid wall panel 324.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. A one-piece carton blank of foldable sheet material formable into an enclosed container, said container being suitable to retain consumable contents therein containing liquids so that said consumable contents can be (1) heated in an oven while retained therein and (2) thereafter consumed while retained therein, said carton blank is cut and scored such that said carton blank includes:

a bottom wall panel having a periphery defined by four interconnecting side fold lines interrelated so that there are four different pairs of adjacent side fold lines wherein each adjacent side fold line of a pair of adjacent side fold lines extends at an angle with respect to each other from a corner point defining one of four corners of said bottom wall panel;

four side wall panels integral with said bottom wall panel along said side fold lines and interrelated so that there are a first pair of opposed side wall panels, a front side wall panel, and a rear side wall panel, said side wall panels being foldable along said side fold lines in a uniform direction relative to said bottom wall panel to form compartment sides;

an integral connection between adjacent side wall panels, said integral connection being foldable and sealable to form leak tight sealed integral corners; and a lid wall panel integral with said rear side wall panel along a lid fold line, said lid wall panel being foldable along said lid fold line in a direction inward toward said bottom wall panel so that in a closed position said lid wall panel encloses a container space defined by said bottom wall panel and said four side wall panels wherein said consumable contents are contained, said lid wall panel having cuts therein defining a vent access section operable to be manually removed from said lid wall panel along a predetermined vent separation path in response to a manual venting procedure so as to expose a vent access opening to an interior of said container space, said vent access section including a grippable portion extending from an edge of said lid wall panel operable to be gripped as an initial step in said manual venting procedure, said lid wall panel having cuts therein defining an eating access section operable to be manually separated along a predetermined eating access separation path in response to a predetermined manual eating access opening procedure so as to enable said eating access section to be manually moved to an access position during said manual eating access operating procedure, the exposure of said vent access opening exposing a portion of said eating access section communicating therewith operable to be gripped as an initial step in said manual eating access operating procedure.

2. A carton blank as defined in claim 1, wherein said vent access section defining cuts include a pair of generally parallel partial depth interior vent cuts in an interior side of said lid wall panel, and a pair of generally parallel partial depth exterior vent cuts in an exterior side of said lid wall panel, said exterior and interior pair of parallel vent cuts being disposed about a corner of said lid wall panel and interrelated such that said lid wall panel delaminates along two generally parallel delamination paths during said manual venting procedure thereby exposing said vent access opening, said delamination paths having edges defined by said exterior and interior pair of parallel vent cuts.

3. A carton blank as defined in claim 2, wherein said interior and exterior parallel vent cuts deviate from said generally parallel relation so as to define said grippable portion of said eating access section.

4. A carton blank as defined in claim 3, wherein said interior and exterior parallel vent cuts are disposed in an arc around said corner of said lid wall panel.

5. A carton blank as defined in claim 4, wherein said grippable venting portion being integral with said lid wall panel and protruding therefrom along an edge of lid wall panel adjacent said lid fold line.

6. A carton blank as defined in claim 1, wherein said first pair of opposed side wall panels have edge wall panels integral with said first pair of opposed side wall panels along edge fold lines, said edge wall panels having first end portions proximate to said front side wall panel, said edge wall panels being foldable in a uniform direction along said edge fold lines so as to extend in a generally parallel relation with said bottom wall panel, said edge wall panels operable to be adhesively adhered in a surface-to-surface abutting relation with said lid wall panel to sealably enclose said container space; and said front side wall panel having a front flap wall panel integral with said front side wall panel along a front flap fold line, said front flap being foldable along said front flap fold line so as to extent in a generally parallel relation with said bottom wall panel, said front flap wall panel operable to be adhesively adhered in a surface-to-surface abutting with said lid wall panel to sealably enclose said container space.

7. A carton blank as defined in claim 6, wherein said front flap wall panel is folded inward with respect to said bottom wall panel, and said lid wall panel includes a front lid flap integral with said lid wall panel along a second edge of said lid wall panel opposite said lid fold line, said front lid flap is foldable along said second edge of said lid wall panel and operable to be adhesively adhered in a surface-to-surface abutting relation with an exposed portion of said front side wall panel when said lid wall panel is in said closed position.

8. A carton blank as defined in claim 7, wherein said second edge of said lid wall panel includes cuts in an exterior side of said lid wall panel operable to enable said lid wall panel to delaminate along said second edge of said lid wall panel during said manual eating access operating procedure.

9. A carton blank as defined in claim 6, wherein said edge fold lines and said front flap fold line are reverse barscored to enable said edge wall panels and said front slap panel to fold outwardly with respect to said bottom wall panel.

10. A carton blank as defined in claim 9, wherein said first end portions of said edge wall panels are extended in a direction parallel said edge fold line, said extended first end portions operable to be adhesively adhered in a surface-to-surface abutting relation with said lid wall panel to sealably enclose said container space.

11. A carton blank as defined in claim 10, wherein an edge wall panel abutting an edge of said lid wall panel when said lid wall panel is in a closed portion includes a first pair of parallel cuts corresponding to said cuts defining said vent access section when said lid wall panel is in a closed position, said first pair of parallel cuts being generally perpendicular to said edge fold lines, a portion of said edge fold line disposed between said first pair of parallel cuts includes an edge fold line cut therein, said front flap wall panel includes a second pair of parallel cuts corresponding to said cuts defining said vent access section when said lid wall panel is in a closed position, said second pair of parallel cuts being generally perpendicular to said flap fold line, and a portion of said flap fold line disposed between said second pair of parallel cuts includes a flap fold line cut therein.

12. A carton blank as defined in claim 11, wherein said lid fold line includes perforations operable to enable said eating access section to be completely removed as a final step in said predetermined manual eating access operating procedure.

13. A carton blank as defined in claim 12, wherein said eating access section defining cuts include parallel partial depth eating access cuts in opposite sides of said lid wall panel operable to enable a portion of sheet material defined between said parallel eating access cuts to delaminate during said predetermined manual eating access operating procedure thereby providing eating access to said consumable contents contained therein.

14. A carton blank as defined in claim 13, wherein said vent access section defining cuts include a pair of generally parallel partial depth interior vent cuts in an interior side of said lid wall panel, and a pair of generally parallel partial depth exterior vent cuts in an exterior side of said lid wall panel, said exterior and interior pair of parallel vent cuts being disposed about a corner of said lid wall panel and interrelated such that said lid wall panel delaminates along two generally parallel delamination paths during said manual venting procedure thereby exposing said vent access opening, said delamination paths having edges defined by said exterior and interior pair of parallel vent cuts.

15. A carton blank as defined in claim 14, wherein said interior and exterior parallel vent cuts deviate from said generally parallel relation so as to define said grippable portion of said eating access section.

16. A carton blank as defined in claim 15, wherein said lid fold line has a first end portion and a second end portion, said lid wall panel includes a first edge adjacent to said first end portion of said lid fold line, a second edge opposite said lid fold line, and a third edge opposite said first edge and adjacent said second end portion of said lid fold line, said predetermined eating access separation path extends from said first end portion of said lid fold line in a parallel relation with said first edge of said lid wall panel to a first portion said vent access section, and said predetermined eating access separation path further extends from a second portion of said second vent access section in a parallel relation with said second and third edges of said lid wall panel so as to terminate at said second end portion of said lid fold line.

17. A carton blank as defined in claim 14, wherein said integral connection includes, a gusset wall panel integral with each pair of adjacent side wall panels along two end fold lines extending from an associated corner point in angularly related relation with respect to one another from said corner point associated with said pair of adjacent fold lines with which said pair of adjacent side wall panels is integral;

said side wall panels foldable along said side fold lines in a uniform direction relative to said bottom wall panel into an erected position while each of said gusset wall panels being foldable along an associated angularly related end fold line in opposite directions with respect to said associated pair of adjacent side wall panels so as to bring each gusset wall panel into surface-to-surface abutting relation with an end portion of one of said associated pair of adjacent side wall panels defined by one of said associated two end fold lines; and an adhesive operable to adhere each of said gusset wall portions in surface-to-surface abutting relation with said associated one side wall end portion to thereby form said sealed integral corners between each pair of adjacent side wall panels which is defined (1) exteriorly by said associated gusset wall panel adhesively adhered in abutting relation to said associated one side wall end portion with said associated one end fold line extending generally in a plane coincident with an interior surface of said associated one side panel from said associated corner point and (2) interiorly by another on said associated two end fold lines extending from a surface of said associated corner point generally along the interior surface of said associated one side wall panel.

18. A carton blank as defined in claim 14, wherein said integral connection includes, a pair of gusset wall panels integral with each pair of adjacent side wall panels along three fold lines extending from an associated corner point in angularly related relation with respect to one another, wherein each set of three angularly related fold lines include a central gusset fold line integrally interconnecting an associated pair of gusset wall panels and two end fold lines integrally interconnecting each pair of adjacent side wall panels to an associated pair of gusset wall panels;

said side wall panels foldable in a uniform direction with respect to said bottom wall panel and each pair of gusset wall panels foldable together in surface-to-surface abutting relation along said central gusset fold line therebetween operable to enable said two end fold lines to be brought into a superposed relation and then folded together along said superposed end fold lines bringing one of two abutted together gusset wall panels into surface-to-surface engagement with one of said associated pair of side wall panels; and an adhesive operable to adhere one of two abutted together gusset wall panels into said surface-to-surface engagement with one of said associated pair of side wall panels.

19. A container package comprising:

a tray formed of sheet material to include a bottom wall having a periphery from which side walls extend upwardly to form a closed peripheral wall structure around said periphery of said bottom wall so as to define a content-receiving tray space;

an edible product in said content-receiving tray-space suitable to be heated in an oven;

a lid mounted on said tray enclosing said edible product within said content-receiving tray space;

said lid having cuts therein defining a vent access section operable to be manually removed from said lid along a predetermined vent separation path in response to a manual venting procedure so as to expose a vent access opening to said interior of said container space, said vent access section including a grippable portion extending from an edge of said lid operable to be gripped as an initial step in said manual venting procedure, said lid having cuts therein defining an eating access section operable to be manually separated along a predetermined eating access separation path in response to a predetermined manual eating access opening procedure so as to enable said eating access section to be manually moved to an access position during said manual eating access operating procedure, the exposure of said vent access opening exposing a portion of said eating access section communicating therewith operable to be gripped as an initial step in said manual eating access operating procedure.

20. A container package as defined in claim 19, wherein said vent access section defining cuts include a pair of generally parallel partial depth interior vent cuts in an interior side of said lid wall panel, and a pair of generally parallel partial depth exterior vent cuts in an exterior side of said lid wall panel, said exterior and interior pair of parallel vent cuts disposed about a corner of said lid wall panel and interrelated such that said lid wall panel delaminates along two generally parallel delamination paths during said manual venting procedure thereby exposing said vent access opening, said delamination paths having edges defined by said exterior and interior pair of parallel vent cuts.

21. A container package as defined in claim 20, wherein said interior and exterior parallel vent cuts deviate from said generally parallel relation so as to define said grippable portion of said eating access section.

22. A container package as defined in claim 21, wherein said interior and exterior parallel vent cuts are disposed in an arc around said corner.

* * * * *